US009855640B2

(12) United States Patent
Krummenauer

(10) Patent No.: US 9,855,640 B2
(45) Date of Patent: Jan. 2, 2018

(54) PROCESSING ELEMENT FOR PROCESSING A PROFILE-SHAPED OR FLAT METALLIC WORKPIECE AND WALL-SHAPED SUPPORTING DEVICE HAVING A PLURALITY OF PROCESSING ELEMENTS MOUNTED THEREUPON

(71) Applicant: LISSMAC MASCHINENBAU GMBH, Bad Wurzach (DE)

(72) Inventor: Stefan Krummenauer, Bad Waldsee-Gaisbeuren (DE)

(73) Assignee: Lissmac Maschinenbau GmbH, Bad Wurzach (DE)

( * ) Notice: Subject to any disclaimer, the term of this patent is extended or adjusted under 35 U.S.C. 154(b) by 0 days.

(21) Appl. No.: 15/279,922

(22) Filed: Sep. 29, 2016

(65) Prior Publication Data

US 2017/0014973 A1 Jan. 19, 2017

Related U.S. Application Data

(63) Continuation of application No. PCT/EP2015/074941, filed on Oct. 28, 2015.

(30) Foreign Application Priority Data

Oct. 30, 2014 (DE) ..... 10 2014 115 778

(51) Int. Cl.
*B24D 13/04* (2006.01)
*B24B 21/06* (2006.01)
(Continued)

(52) U.S. Cl.
CPC ..... *B24D 13/04* (2013.01); *B24B 21/04* (2013.01); *B24B 21/06* (2013.01); *B24B 29/005* (2013.01); *B24D 13/10* (2013.01); *B24D 13/12* (2013.01)

(58) Field of Classification Search
CPC ..... B24D 13/04; B24D 13/10; B24D 13/12; B24B 21/04; B24B 21/06; B24B 21/16; B24B 29/005
See application file for complete search history.

(56) References Cited

U.S. PATENT DOCUMENTS 2,069,900 A 2/1937 Perazzoli
3,410,032 A 11/1968 Meinerding
(Continued)

FOREIGN PATENT DOCUMENTS

DE 103 20 295 A1 5/2004
DE 20 2005 011 640 U1 10/2005
DE 20 2013 009 564 U1 1/2014

OTHER PUBLICATIONS

German Search Report (Application No. 10 2014 115 778.8) dated Sep. 28, 2015.
(Continued)

*Primary Examiner* — Timothy V Eley
(74) *Attorney, Agent, or Firm* — Burr & Brown, PLLC

(57) ABSTRACT

A processing element for processing a profile-shaped or flat metallic workpiece, with the processing element designed such that a plurality of similar processing elements can be arranged one behind the other on a supporting device in the longitudinal direction of the supporting device, the supporting device can be driven in a circulating manner and the plurality of processing elements can be guided past the workpiece for surface processing at least approximately linearly by means of the supporting device. A rectangular or block-shaped main body having bearing surfaces for bearing on the supporting device is provided, and oblong ribs protruding outward in a web-like manner are provided on the main body on opposite flat longitudinal sides and overlap the corresponding opposite flat longitudinal sides of the
(Continued)

main body on an identically embodied processing element, which is arranged between the ribs.

11 Claims, 6 Drawing Sheets

(51) Int. Cl.

| | |
|---|---|
| ***B24B 21/04*** | (2006.01) |
| ***B24B 29/00*** | (2006.01) |
| ***B24D 13/10*** | (2006.01) |
| *B24D 13/12* | (2006.01) |

(56) References Cited

U.S. PATENT DOCUMENTS

| | | | | |
|---|---|---|---|---|
| 3,699,727 | A * | 10/1972 | McDonald | B24D 11/00 451/466 |
| 7,789,735 | B2 | 9/2010 | Weiland | |
| 2005/0272353 | A1 | 12/2005 | Weiland | |
| 2016/0375541 | A1* | 12/2016 | Weber | B24B 7/06 451/298 |

OTHER PUBLICATIONS

International Search Report and Written Opinion (Application No. PCT/EP2015/074941) dated Feb. 12, 2016.

* cited by examiner

PROCESSING ELEMENT FOR PROCESSING A PROFILE-SHAPED OR FLAT METALLIC WORKPIECE AND WALL-SHAPED SUPPORTING DEVICE HAVING A PLURALITY OF PROCESSING ELEMENTS MOUNTED THEREUPON

CROSS REFERENCE TO RELATED APPLICATIONS

This application is a continuation of International Application No. PCT/EP2015/074941 filed Oct. 28, 2015, which designated the United States, and claims the benefit under 35 USC §119(a)-(d) of German Application No. 10 2014 115 778.8 filed Oct. 30, 2014, the entireties of which are incorporated herein by reference.

FIELD OF THE INVENTION

The present invention relates to a processing element for processing a profile-shaped or flat metallic workpiece and a wall-shaped supporting device having a plurality of processing elements mounted thereupon.

BACKGROUND OF THE INVENTION

Grinding blocks having a main body which has a framed receiving region with a recess for receiving a multiplicity of abrasive paper strips stood therein are known from the prior art. The main body has, on the bearing side, a groove-shaped indentation which fits together with a ridge on a supporting strip so that, in a mounted state, i.e. in a state in which the grinding block is screwed on, for example, a rotation of the grinding block as a workpiece is being processed is avoided by means of a form fit between the groove-shaped indentation on the underside of the grinding block and the matching ridge on the supporting strip, when the processing strip with a multiplicity of grinding blocks mounted thereupon is moved transversely to a workpiece.

SUMMARY OF THE INVENTION

The object of the present invention is to design a supporting strip with processing elements more simply.

The present invention proceeds from a processing element for processing a profile-shaped or flat metallic workpiece, wherein the processing element is designed such that a plurality of similar processing elements are arranged one behind the other on a supporting device in the longitudinal direction of the supporting device, wherein the supporting device can be driven in a circulating manner and the plurality of processing elements can be guided past the workpiece for surface processing at least approximately linearly by means of the supporting device, wherein the processing element has two protruding engagement portions on the front side and receiving portions formed on the rear side, and wherein the engagement portions and the receiving portions cooperate in the mounted state of the processing element on the supporting device such that the engagement portions of one processing element come into contact with the receiving portions of a next processing element on the supporting device, so that a rotation of the processing elements transversely to the longitudinal direction of the supporting device is prevented, characterized in that a rectangular or block-shaped main body having a bearing surface for bearing on the supporting device is provided, and in that oblong ribs protruding outward in a web-like manner are provided on the main body on opposite flat longitudinal sides and overlap the corresponding opposite, in particular, parallel longitudinal sides of the main body on an identically embodied processing element, which is arranged between the ribs.

As a result of this measure, a fork arrangement is formed by the ribs on the longitudinal sides of a main body and cooperates in a matching manner with the longitudinal faces of a main body of an identical processing element slid between the ribs in order to provide an anti-twist mechanism. As a result of the "fork creation", the processing elements can tilt relative to one another on a supporting device driven in a circulating manner, for example, on a circulating belt as it bends, for example, around a driving roller, but can still remain in contact with the longitudinal sides of an adjacently mounted processing element due to the predefined protruding ribs.

In a particularly preferred embodiment of the present invention, the main body comprises a preferably framed receiving region with a recess for receiving a plurality of grinding means arranged upright therein. Grinding means, for example, include abrasive paper strips which are arranged in the receiving region stacked above a suitable intermediate layer such that the abrasive paper front sides of the strips point in the processing direction. Other types of abrasive oblong grinding elements are also conceivable, such as brush elements or the like.

It is also preferred when the receiving region of the processing element has a single continuous recess. For example, upright oblong grinding means can be poured into a recess of this type.

In an embodiment of the present invention that is more preferred, a laterally protruding receiving body with receiving region is provided on the main body. The receiving body is preferably formed in one piece with the main body. This has the advantage that the ribs on the main body can be accommodated laterally within a projected face of the receiving body when viewing the receiving body in plan view. The ribs then protrude to the front only on the front side so as to be able to cooperate with the identically shaped main body of a processing element arranged in front.

It is additionally preferred when the ribs protrude to the front with a predefined overhang beyond a front side of the main body in a direction parallel to the bearing surface.

The overhang should be dimensioned such that there is also still contact with an identical processing element mounted in front of the front side when the processing elements mounted on a supporting device are guided around a deflection roller or driving roller, wherein the processing elements tilt relative to one another as a result of the bending of the supporting device, for example, a supporting belt.

In a particularly advantageous embodiment of the present invention, the overhang is greater than 25% of the length of the main body. The overhang is preferably less than 30% of the length of the main body.

It is additionally advantageous when the ribs are omitted in a rear portion of the main body relative to a front side with protruding ribs, so that the ribs of a processing element arranged identically therebehind can receive the main body between them. This means that an overhang of the ribs should, in particular, be matched to a free region in the rear region of a main body so that protruding ribs and ribs starting on another main body cannot interfere with one another in any position of the processing elements.

In an additionally preferred embodiment of the present invention the ribs protrude on the front side substantially to an extent exactly the same as that to which ribs are not provided in the rear portion of the longitudinal side, such that, with processing elements arranged one behind the other and as a result of adjacently arranged processing elements, the ribs have only approximately a gap equal to the distance at which the processing elements are mounted from one another.

In order to obtain an optimized cooperation of processing elements mounted adjacently, it is preferred when the ribs are formed in a supplementary manner on the processing elements substantially without gaps, continuously in the longitudinal extent.

In order to obtain an advantageous cooperation of adjacently arranged processing elements, it is additionally proposed for the shape of a front portion of the particular rib to be matched to the shape at the rear end of the rib. For example, the front ends of the ribs are rounded and match an accordingly concave shape at the end of the ribs.

A multiplicity of processing elements with the grinding means arranged upright are preferably mounted on a strip-shaped support, for example, a plastic belt, which can be used in a corresponding processing machine as processing tool.

BRIEF DESCRIPTION OF THE DRAWINGS

A plurality of exemplary embodiments of the present invention are explained in the figures in greater detail with specification of further advantages and details.

DETAILED DESCRIPTION OF THE INVENTION

Figure 1:
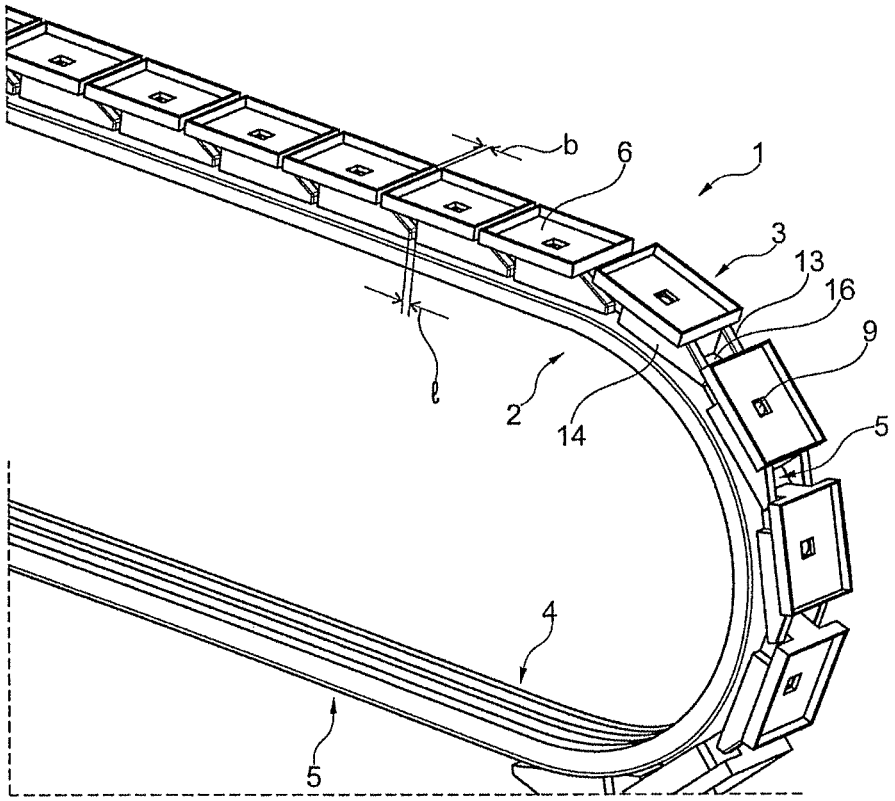
FIG. 1 shows a perspective view obliquely from above of a processing belt having base supports of processing elements.

In FIG. 1 a processing belt 1 with a supporting belt 2 and base supports 3 arranged thereupon for processing elements is illustrated, i.e. processing elements without grinding means fixed upright thereon, for example, abrasive sheets, which are each glued in place spaced apart from one another by one or more further layers.

Figure 2A:
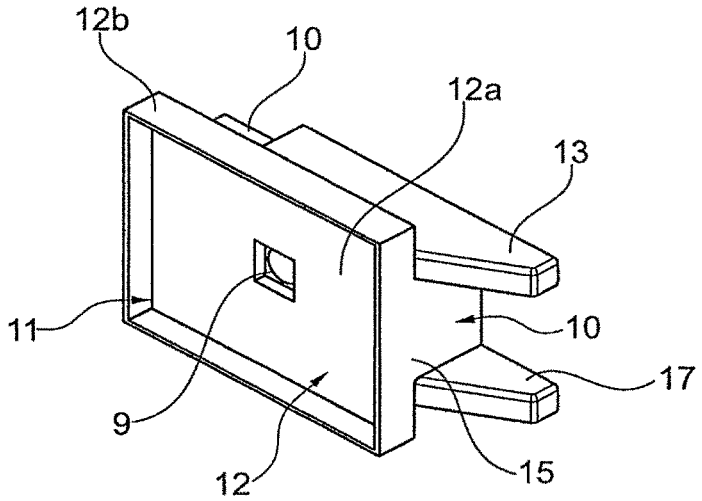
FIGS. 2*a* to 2*e* show a base support according to FIG. 1 in a perspective view (FIG. 2*a*), a plan view (FIG. 2*b*), a section along the line C-C in the plan view of FIG. 2*b* (FIG. 2*c*), a side view (FIG. 2*d*), and a rear view (FIG. 2*e*)
Figure 2B:
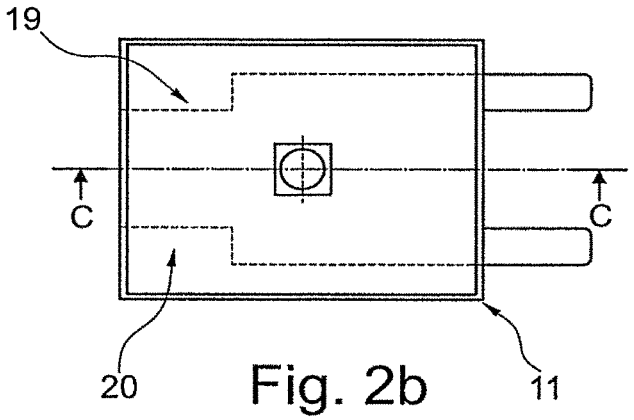
Figure 2C:
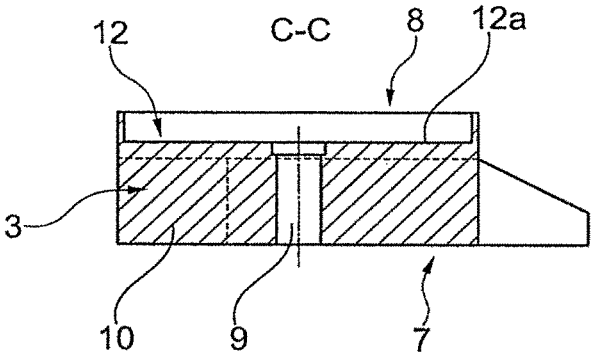
Figure 2D:
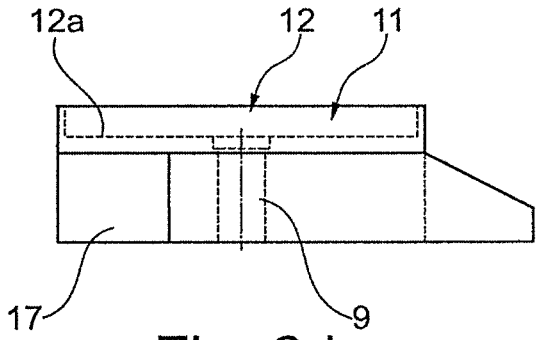
Figure 2E:
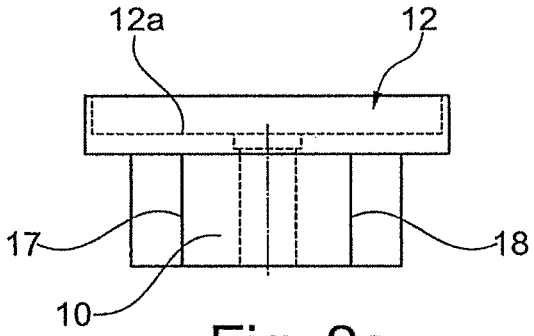

The supporting belt 2 is formed, for example, on the inner side 4 as a multi-V-ribbed belt, intended for a corresponding driving wheel. On an outer side 5, there sit the base supports 3, which are preferably screwed from the inner side. For this purpose, the threaded hole (for example, see FIGS. 2*a* and 2*c*) extending continuously from an underside 7 (see FIG. 2*c*, for example) to an upper side 8 of the base support 3 is visible in a receiving region 6 of the base support 3.

The base support 3 comprises, as is visible, in particular, from FIG. 2, a main body 10, which is block-shaped in the embodiment of the base support 3.

A receiving body 11 is arranged on the main body 3 protruding laterally beyond the main body 10. A receiving region 12 having a recess 12*a* for receiving a plurality of grinding means (not illustrated) arranged upright therein is provided on the receiving body 11.

In order to ensure that the grinding means can be fixed in a predefined manner in the receiving region 12 of the receiving body 11, the receiving region 12 has a circumferential frame 12*b* around the recess 12*a*.

The frame 12*b*, for example, comprises a plurality of vertically extending wall portions.

Ribs 13, 14 are formed on the main body 10 and protrude via a predefined overhang of, for example, 10 to 30 mm beyond a front side 15 (see FIG. 2*a*) in a direction, in particular, parallel to the bearing surface 5 of the supporting belt 2, based on a mounted state.

The ribs 13, 14 are guided further over a part of flat longitudinal sides 17, 18.

However, the ribs 13, 14 are omitted in a rear portion 19, 20 (see FIG. 2*b*, in particular) relative to the front side 15. The ribs of a processing element or base support 3 arranged identically therebehind can thus receive the main body 10 between them.

As can be seen, in particular, from FIG. 1, ribs 13, 14 protrude on the front side 15 substantially to an extent exactly the same as that to which the ribs 13, 14 are omitted in rear portions 19, 20, such that, with base supports 3 arranged one behind the other, the ribs 13, 14 preferably have only a gap l equal to the distance, of dimension b, defined between the base supports 3 and adjacently arranged processing supports 3.

In this way, the possibilities of guidance by adjacently arranged base supports is utilized to the maximum.

Figure 2F:
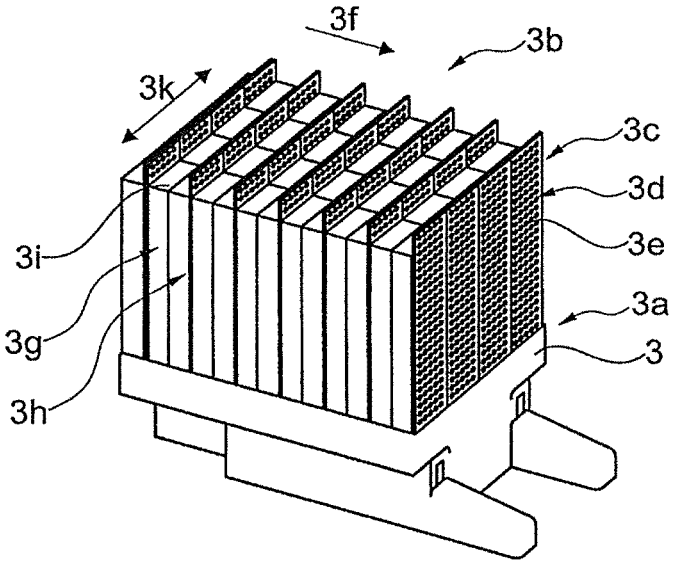
FIG. 2*f* shows a processing element in a perspective view.

In FIG. 2*f* a complete processing element 3*a* is illustrated. It comprises the base support 3 and a grinding arrangement 3*b*. The grinding arrangement 3*b* comprises a plurality of grinding sheet layers 3*c*, for example, seven layers each formed of a plurality of, for example, four grinding sheets 3*d*. An abrasive side 3*e* of the grinding sheets 3*d* points in each case in a direction, specifically a grinding direction 3*f*, which corresponds to the direction of movement of the supporting belt 2 with processing elements 3*a* mounted thereon.

One or more grinding fleece layers, in the present case two grinding fleece layers 3*g*, 3*h*, are arranged between the individual grinding sheet layers 3*c* and serve as protective layers for the grinding sheets 3*d*. Other types of supporting layers, which, for example, have a fleece character, are also conceivable. As also illustrated in FIG. 2*f*, the grinding sheets 3*d* preferably protrude beyond the grinding fleece layers 3*g*, 3*h*.

In order to achieve a high flexibility, the grinding fleece layers 3*g* and 3*h* are preferably formed by individual grinding fleece portions 3*i* separate from one another, such that a plurality of adjacently arranged grinding fleece portions 3*i* divided in a vertical direction form the grinding fleece layers 3*g* and 3*h*. The grinding fleece portions, as considered in a width direction 3*k*, preferably have the same division as the grinding sheets 3*d*, such that an individual grinding sheet 3*d* can yield upon contact with a workpiece that is to be ground, as a result of the grinding fleece portions 3*i* arranged therebehind being pressed together, without this compression being transmitted to adjacent grinding sheets of the grinding fleece portions 3*i*.

The grinding arrangement 3*b* formed of grinding sheet layers 3*c* and grinding fleece layers 3*g*, 3*h* are glued, for example, in the receiving region 12 of the receiving body 12.

Figure 3:
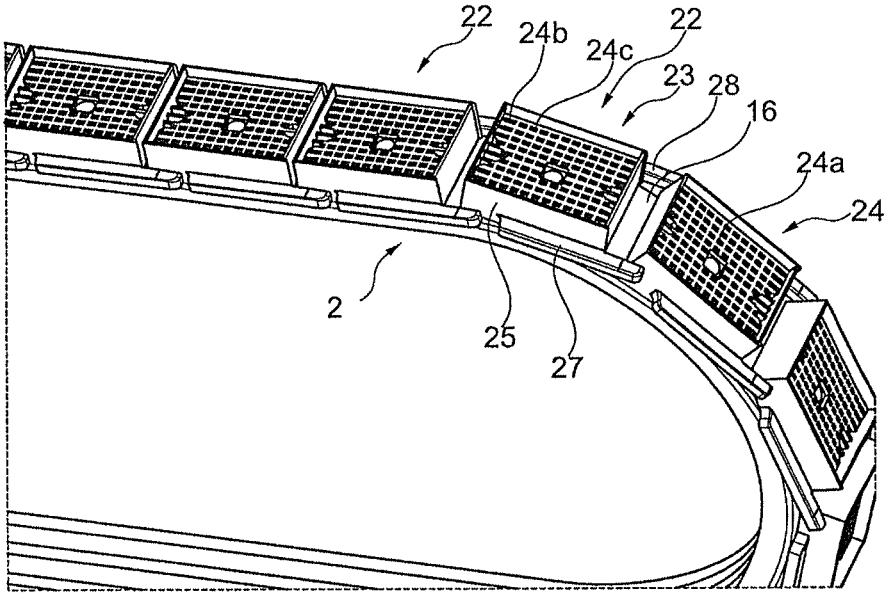
FIG. 3 shows a further embodiment of a processing belt in a perspective view corresponding to FIG. 1.
Figure 4A:
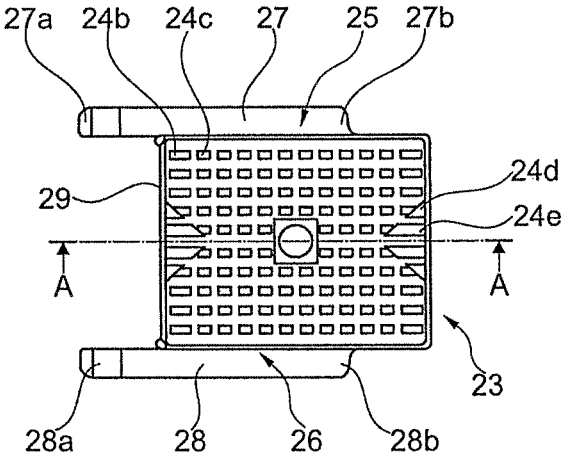
FIGS. 4*a* and 4*b* show a base support from the processing belt according to FIG. 3 in a plan view (FIG. 4*a*) and in a sectional view along the line of section A-A (FIG. 4*b*)
Figure 4B:
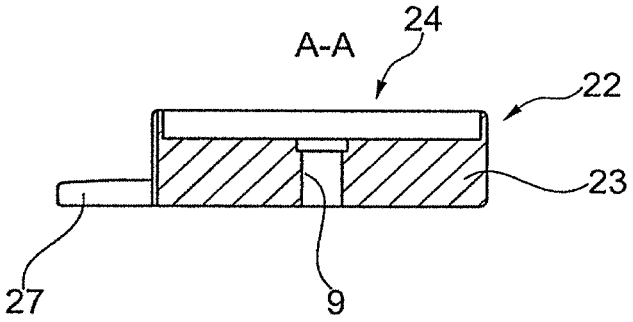

A further embodiment of a processing belt 21 is illustrated in FIG. 3. The supporting belt 2 corresponds to that from FIG. 1. The base supports 22 differ, however, from the base supports 3. In this embodiment a receiving region 24 having a recess 24*a* is provided directly on a main body 23. The base of the recess 24*a* has a multiplicity of indentations 24*b*, 24*c*, 24*d* and 24*e*.

The indentations can be used, for example, to provide an improved hold for adhesives or casting materials with which grinding means are fixed in the recess 24*a*.

The main body 23 also has a threaded hole 9 in order to enable the mounting of the base support 22 with grinding means on the supporting belt 2 on a bearing surface 16.

The base supports 3, 22 preferably sit directly on the bearing surface 16 of the supporting belt in the fixed state.

Since they have a central fastening via the threaded hole 9, they can be removed from the bearing surface 16 in the event of a bending of the supporting belt 2, in particular, in the region of a driving wheel (not illustrated), such that the supporting belt 2 can continue to run in a manner uninfluenced by the rigid base supports 3, 22, even in the curved regions.

Figure 5:
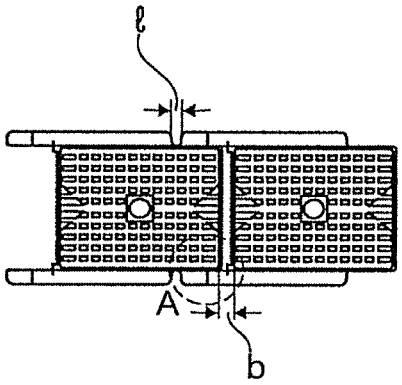
FIG. 5 shows two base supports from the processing belt according to FIG. 3 in a position assembled one behind the other in a plan view.

The base supports 22 have ribs 27, 28 on longitudinal sides 25, 26, which ribs protrude beyond a front side 29 with an overhang of, for example, 10 to 30 mm, and in the present case 20 mm. The distances 1 between the ribs (see FIG. 5) correspond substantially to the distances b between the main bodies 23.

Figure 5A:
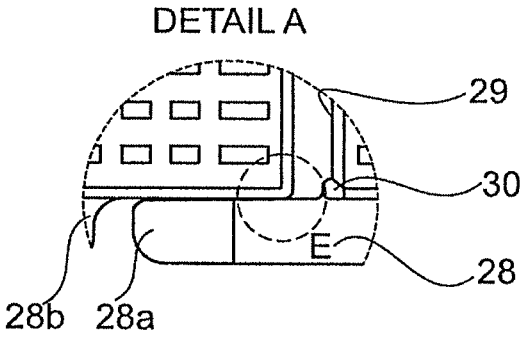
FIG. 5*a* shows the marked detail A in an enlarged view.

The ribs 27, 28 have, in their front portion 27*a* or 28*a*, a shape which is matched to the shape at the rear end 27*b* or 28*b* of the rib, such that the ribs 27, 28 of adjacent processing elements or base supports are arranged adjacently in a matching manner in the case of identical processing elements or base supports (see FIG. 5*a*, in particular).

Figure 5B:
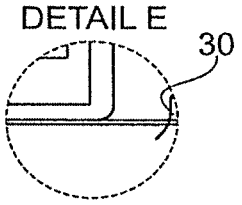
FIG. 5*b* shows the detail E marked in FIG. 5*a* in an enlarged view.

A further detail can be seen in FIGS. 5*a* and 5*b*. At the transition of the rib 28 on the front side 29 of the main body 23, a bead-like material portion 30 is provided in order to enable an optimized flow of force in respect of applied forces, whereby the risk of a crack between the particular rib 27, 28 and the corresponding longitudinal side 25, 26 or the front side 29 is reduced.

Figure 6A:
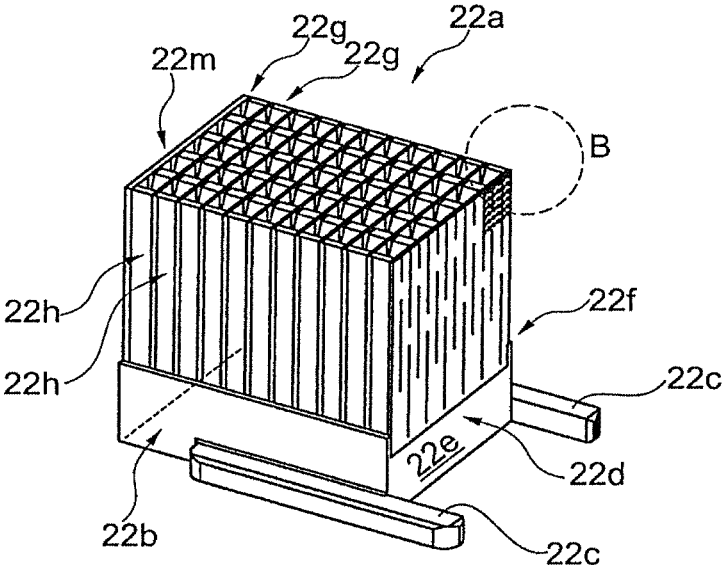
FIGS. 6*a* and 6*b* show a processing element in a perspective view (FIG. 6*a*) and in an enlarged partial view of the detail B in FIG. 6*a* (FIG. 6*b*).

FIG. 6*a* shows a complete processing element 22*a* with a base support 22*b* which corresponds substantially to the base support 22. Only the ribs 22*c* and a front side 22*d* are formed slightly differently.

In particular, the front side 2*d* has a front wall 22*e* which is lower compared to a front side of the base support 22.

A plurality of grinding sheet layers 22*g* and a plurality of grinding fleece layers 22*h* are combined in a grinding arrangement 22*m* in a receiving region 22*f*.

Figure 6B:
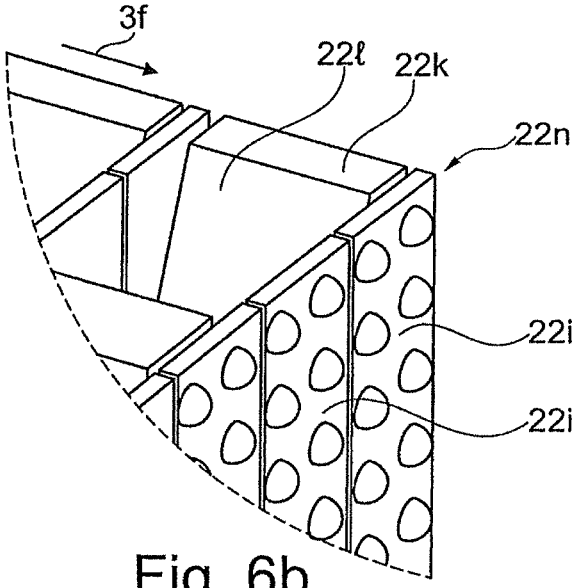

As is the case with the processing element 3*a*, the grinding sheet layers 22*g* are composed of individual grinding sheets 22*i* and the grinding fleece layers 22*h* are composed of individual grinding fleece portions 22*k*. In the embodiment according to FIGS. 6*a* and 6*b*, the division is such that two grinding sheets 22*i* sit in front of a grinding fleece portion 22*k* as considered in the processing direction 3*f*.

The grinding fleece portions 22*k* have approximately the same height as the grinding sheets 22*i*, but are provided with a chamfer 22*l* on one side. The grinding arrangement 22*m* is thus able to adapt better to workpieces that are to be processed, due to a greater mechanical flexibility of a front region 22*n* of the grinding arrangement 22*m*.

LIST OF REFERENCE SIGNS

1 processing belt
2 supporting belt
3 base support
3*a* processing element
3*b* grinding arrangement
3*c* grinding sheet layer
3*d* grinding sheet
3*e* abrasive side
3*f* grinding direction
3*g* grinding fleece layer
3*h* grinding fleece layer
3*i* grinding fleece portion
3*k* width direction
4 inner side
5 outer side
6 receiving region
7 underside
8 upper side
9 threaded hole
10 main body
11 receiving body
12 receiving region
12*a* recess
12*b* frame
13 rib
14 rib
15 front side
16 bearing surface
17 longitudinal side
18 longitudinal side
19 portion
20 portion
21 processing belt
22 base support
22*a* processing element
22*b* base support
22*c* rib
22*d* front side
22*e* front wall
22*f* receiving region
22*g* grinding sheet layer
22*i* grinding sheet
22*k* grinding fleece portion
22*l* chamfer
22*m* grinding arrangement
23 main body
24 receiving region
24*a* recess
24*b* indentation
24*c* indentation
24*d* indentation
24*e* indentation
25 longitudinal side
26 longitudinal side
27 rib
27*a* front portion
27*b* rear side
28 rib
28*a* front portion
28*b* rear end
29 front side
30 bead-like material portion

The invention claimed is:

1. A processing element for processing a profile-shaped or flat metallic workpiece, wherein the processing element is designed such that on a supporting device a plurality of the processing elements are arranged adjacently in a mounted state in a longitudinal direction of the supporting device, wherein the supporting device can be driven in a circulating manner and the plurality of processing elements can be guided past the workpiece for surface processing at least approximately linearly by means of the supporting device, wherein each processing element has two protruding engagement portions on a front side and receiving portions formed on a rear side, wherein the engagement portions and the receiving portions cooperate in the mounted state of respectively adjacent processing elements on the supporting device, such that the engagement portions of one processing element come into contact with the receiving portions of a next processing element on the supporting device, so that a rotation of the processing elements transversely to the longitudinal direction of the supporting device is prevented, wherein each processing element has a block-shaped main body having bearing surfaces provided for bearing on the supporting device, and wherein oblong ribs protruding outward in a web-like manner are provided as the engagement portions on the main body of each processing element so as to be on opposite flat longitudinal sides and overlap corresponding opposite flat longitudinal sides provided as the receiving portions of the main body on an identically embodied adjacent processing element, which is arranged between the ribs.

2. The processing element as claimed in claim 1, wherein the main body comprises a receiving region with a recess for receiving a plurality of grinding means arranged upright therein.

3. The processing element as claimed in claim 2, wherein the receiving region of the processing element is a single recess with circumferentially closed side wall portions.

4. The processing element as claimed in claim 1, further comprising a laterally protruding receiving body on the main body, and including a receiving region with a recess for receiving a plurality of grinding members arranged upright therein.

5. The processing element as claimed in claim 1, wherein the ribs protrude frontward beyond a front side of the main body in a direction parallel to the bearing surface by a predefined overhang.

6. The processing element as claimed in claim 5, wherein the ribs protrude greater than 25% of the length of the main body.

7. The processing element as claimed in claim 1, wherein in a rear portion of a preceding main body the corresponding opposite flat longitudinal sides are sized relative to a front side of a succeeding main body having protruding ribs, such that the protruding ribs of a processing element arranged immediately therebehind can receive the preceding main body.

8. The processing element as claimed in claim 1, wherein the ribs have a front side and a back side, with the front side of the ribs in a succeeding main body protruding toward the back side of the ribs in a preceding main body, such that, with processing elements arranged one behind the other and as a result of adjacently arranged processing elements, a gap between the front side and the back side of the respective ribs is equal to the distance at which the processing elements are mounted from one another.

9. The processing element as claimed in claim 1, wherein a shape of a front portion of the rib is matched to a shape on a rear portion of the rib, such that the ribs of adjacent processing elements are arranged adjacently in a matching manner.

10. A belt-like supporting device having a multiplicity of processing elements as claimed in claim 1 mounted thereupon with grinding members arranged upright therein.

11. The processing element as claimed in claim 1, wherein the processing element has a rectangular shaped main body.

* * * * *